United States Patent [19]

Olsen

[11] Patent Number: 4,780,064

[45] Date of Patent: Oct. 25, 1988

[54] PUMP ASSEMBLY AND ITS METHOD OF OPERATION

[75] Inventor: John H. Olsen, Vashon, Wash.

[73] Assignee: Flow Industries, Inc., Kent, Wash.

[21] Appl. No.: 828,156

[22] Filed: Feb. 10, 1986

[51] Int. Cl.[4] ..... F04B 17/00

[52] U.S. Cl. ..... 417/397; 417/404; 91/352; 91/383; 91/405

[58] Field of Search ..... 91/383, 350, 352, 303, 91/22, 404, 405; 417/397, 404

[56] References Cited

U.S. PATENT DOCUMENTS

| | | | |
|---|---|---|---|
| 526,930 | 10/1894 | Maxon | 91/383 |
| 1,714,425 | 5/1929 | Knab | 417/397 |
| 2,570,624 | 10/1951 | Wyckoff | 91/383 X |
| 2,592,940 | 4/1952 | Monoyer . | |
| 2,826,149 | 3/1958 | Wrigley | 417/397 X |
| 3,141,415 | 7/1964 | Chute | 417/397 X |
| 3,179,056 | 4/1965 | Wright . | |
| 3,318,197 | 5/1967 | McNamee . | |
| 3,353,490 | 11/1967 | Wright . | |
| 3,816,029 | 6/1974 | Bowen | 417/223 |
| 4,359,312 | 3/1982 | Funke | 417/18 |
| 4,548,550 | 10/1985 | Tsuji | 417/394 |

*Primary Examiner*—Carlton R. Croyle
*Assistant Examiner*—Ted Olds
*Attorney, Agent, or Firm*—Flehr, Hohbach, Test, Albritton & Herbert

[57] ABSTRACT

An overall pump assembly for smoothly pumping a compressable liquid from a supply is disclosed herein along with two intensifiers which form part of the assembly and a control arrangement for driving the intensifiers in specific phase relationship to one another. Each of the intensifiers includes its own reciprocating piston and a control device interconnected in feedback relationship with the piston in order to follow the latter through its movement. In each of the specific intensifiers disclosed, its piston and control device are interconnected by cable means configured to cause the control device to rotate about its own axis in a manner corresponding to the movement of the piston.

14 Claims, 7 Drawing Sheets

PUMP ASSEMBLY AND ITS METHOD OF OPERATION

The present invention relates generally to fluid pumping apparatus and more particularly to a specifically designed high pressure hydraulic pump assembly utilizing specifically designed hydraulic pumps.

It is known to combine fluid actuated pumps in order to provide an overall assembly which pumps water or other such liquid in a continuous, pulsation-free manner. See for example U.S. Pat. No. 3,816,029 (BOWEN et al). Where it is desirable to provide a high pressure output stream, for example in the neighborhood of 20,000 psi or higher, hydraulic drive type pumps are often utilized. Such a pump includes a large piston which is typically reciprocated by oil and in turn drives smaller plungers on opposite sides of the piston in order to produce alternating high pressure streams. The driving pressure is directly related to the output pressure by the area ratio between the drive piston and output plungers.

The type of pump just recited is commonly referred to as an intensifier and one presently in use is, in part, schematically illustrated in FIG. 1. The device illustrated there, generally indicated by the reference numeral 10, is specifically shown including an intensifier piston 12 having opposing plungers 14 disposed within a cylinder housing diagrammatically shown at 16. The piston is driven back and forth within the cylinder housing by means of a control arrangement including a main spool valve 18 and a pilot valve 20. When the piston reaches the end of its stroke, it makes mechanical contact with a pin 22, (one at each end of the cylinder housing) which acts on a push cable 24 to shift a pilot spool 26 forming part of the pilot valve. As a result, the pilot valve ducts oil through an orifice to the ends of a main spool 28 forming part of main valve 18, causing the main spool to shift axially within its valve housing 30. The speed of shifting of the main spool can be controlled by sizing the control orifice 32 between the two valve spools. Once the shift is completed, there is no further control over the piston motion. It is completely determined by the water pressure in the high-pressure cylinder and the characteristics of the hydraulic pump.

There are two sources of hydraulic shock in the system just described. First, as the main spool crosses center, it usually presents a different resistance to the hydraulic circuit then does the fully opened valve with oil acting on the piston. The pressure and/or flow in the circuit must then adjust rapidly to the new circumstances resulting in hydraulic shock. This situation is somewhat alleviated by grinding the main spool to let the cross over conditions mimic the load of the operating intensifier, as described in U.S. Pat. Nos. 3,811,795 and 4,029,440.

A second cause of hydraulic shock or concern relates to the compressability of the water or other such fluid being pumped by the intensifier piston. When the piston begins its stroke, the fluid being pumped is at a relatively low pressure, for example in the case of water, it is at about 100 psi. The piston must move about $\frac{1}{8}$ of its stroke before the pressure builds to the intensifier's outlet pressure, for example in the neighborhood of 60,000 psi. A pressure compensated hydraulic pump increases its flow in an attempt to maintain pressure during this compression segment of the stroke, producing a surge in flow rate. On the other hand, a constant volume pump holds the flow rate but lets the pressure drop causing a large dip in output pressure. In either case, transients are generated during this segment of the intensifier stroke. Heretofore, there have been attempts to smooth or alleviate these transients by using accumulators in the hydraulic circuit to supply all the oil need for the compression segment of the stroke. However, it has generally been found that accumulators in the pressure line cause pulses in the return line.

It has been found that the problem discussed above can be alleviated by controlling in a specific way the action of the piston forming part of each intensifier making up the overall pump system. More specifically, as will be described in detail hereinafter, in a preferred embodiment of the present invention, two such intensifiers are used and movement of their respective pistons are controlled in a way which insures that (1) at least one piston is fully ported to its pressurized drive fluid without any flow restriction and (2) each piston moves through the compression segment of its stroke while throttled to control its motion.

In order to control piston movement in an intensifier, it is desirable to be able to continuously monitor that movement and through feedback means provide the desired control. Presently, there are known devices which utilize feedback schemes to at least monitor if not control piston movement. Two such techniques are disclosed in U.S. Pats. Nos. 3,318,197 and 3,816,029. As will be described in more detail hereinafter, the present invention provides still another approach, which, as will be seen, is uncomplicated and yet quite reliable.

In view of the foregoing, it is an object of the present invention to provide an overall pump assembly which minimizes the problems discussed above in an uncomplicated and reliable way.

Another object of the present invention is to provide an improved intensifier designed such that the reciprocating movement of its piston is reliably controlled in an uncomplicated manner.

A more particular object of the present invention is to provide an overall pump assembly which utilizes at least two intensifiers of the type just recited and which drives the pistons of these intensifiers in a way that (1) requires no accumulator in either the hydraulic circuit for driving the pistons or the output water circuit, (2) can achieve high stroke rates without hydraulic shock, and (3) does not require a hydraulic pump to rapidly compensate for the compression segment of each stroke.

Still another particular object of the present invention is to provide an uncomplicated and yet reliable technique for coordinating the movement of the pistons of two intensifiers forming part of an overall pump assembly in a way which achieves the other objectives recited above.

As will be described in more detail hereinafter, the particular type of intensifier disclosed herein includes means defining a cylinder housing and a piston movable back and forth within the housing between opposite first and second inlet/outlet ports. Means defining first and second pumping chambers cooperate with opposite ends of the piston and a supply of pumping fluid for drawing the pumping fluid into one of the chambers while simultaneously expelling pumping fluid out of the other of the chambers by the action of the piston moving from its position adjacent one chamber to its position adjacent the other chamber. This results in the back and forth movement of the piston alternatively defining an intake stroke with respect to the one chamber and an output stroke with respect to the other chamber. At the outset, it is important to note that the output stroke includes two segments thereof, an initial compression segment during which the pumping fluid within the pumping chamber is not sufficiently compressed to be expelled from that chamber and a subsequent expulsion segment during which the pumping fluid within the chamber is sufficiently compressed to be expelled therefrom.

Still describing the specific intensifier disclosed herein, the latter utilizes drive means including a supply of drive fluid under pressure and control means for directing pressurized drive fluid from its supply into the cylinder housing alternatively through each of the inlet/outlet ports in a flow controlled manner. At the same time, the other of the ports is maintained in fluid communication with a sufficiently low pressure environment relative to the pressurized drive fluid to cause the piston to move away from the port receiving the pressurized fluid and towards the other port in order to carry out the intake and output strokes. A control arrangement is provided and designed so that it can act on the drive means of the intensifier such that (1) during the expulsion segment of the output stroke of the piston, the inlet/outlet port receiving pressurized drive fluid to provide such movement is continuously maintained in a fully opened condition and (2) during the compression segment of the output stroke, the same inlet/outlet port functions as a servo valve with feedback control over the piston position to cause the piston to move slowly in its compression mode.

As will also be described in detail hereinafter, one aspect of the present invention provides for an overall high pressure pump assembly which utilizes two intensifiers of the type just described including the control valve arrangement just recited. This control valve arrangement operates the pistons in the manner just described and also causes the pistons of the two intensifiers to reciprocate through alternating intake and output strokes in a fixed phase relationship to one another while insuring that at least one of the valves is always fully opened in the expulsion segment of the output stroke.

As indicated above, the type of intensifier disclosed herein includes a piston movable back and forth within the cylinder housing and hydraulic drive means for causing the piston to move in that way. In order to control the position of the piston during the compression segment, the drive means includes a control valve, for example a spool of the type described previously, rotatable about its own axis. The control valve is interconnected with the piston by cable means such that the back and forth movement of the piston causes the cable means to rotate the control valve spool about its own axis in a manner corresponding to the back and forth movement of the piston, whereby the rotational position of the control valve spool at any point in time in the operation of the intensifier corresponds to the specific position of the piston along its path of movement. Moreover, the rotational position is converted to an axial position by means of a screw thus providing a feed back which closes the valve in response to motion of the piston caused by the open valve.

In accordance with another aspect of the present invention, the drive means just recited includes a supply of fluid under pressure and a low pressure environment interconnected through a hydraulic circuit extending between the supply, the cylinder housing, and the low pressure environment. The cable means is disposed entirely within this hydraulic circuit, thereby making seals around the cable with respect to the ambient surroundings unnecessary. In accordance with still another aspect of the present invention, the cable means discussed immediately above consists of first and second separate cables interconnecting the piston with the control valve spool such that the movement of the piston causes the cables to simultaneously wind around and unwind from the control valve spool as the latter is caused to rotate in the manner corresponding to the movement of the piston.

The foregoing objects and features of the present invention, as briefly described above, will be described in more detail hereinafter in conjunction with the drawings wherein:

FIG. 1 schematically illustrates a present state of the art intensifier having piston motion controls which are not designed in accordance with the present invention;

FIG. 2 diagrammatically illustrates an overall high pressure pump assembly including an intensifier designed in accordance with one embodiment of the present invention;

FIGS. 3 and 4 diagrammatically illustrate the intensifier of FIG. 2 in two extreme operating conditions;

FIGS. 5A–C diagrammatically illustrate how the intensifier of FIG. 2 operates to move its piston in a reciprocating fashion;

Figure 11:
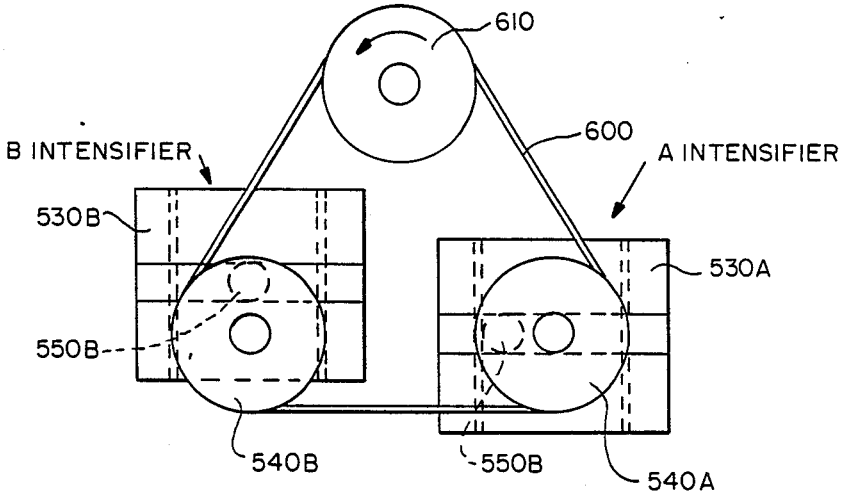
Figure 8:
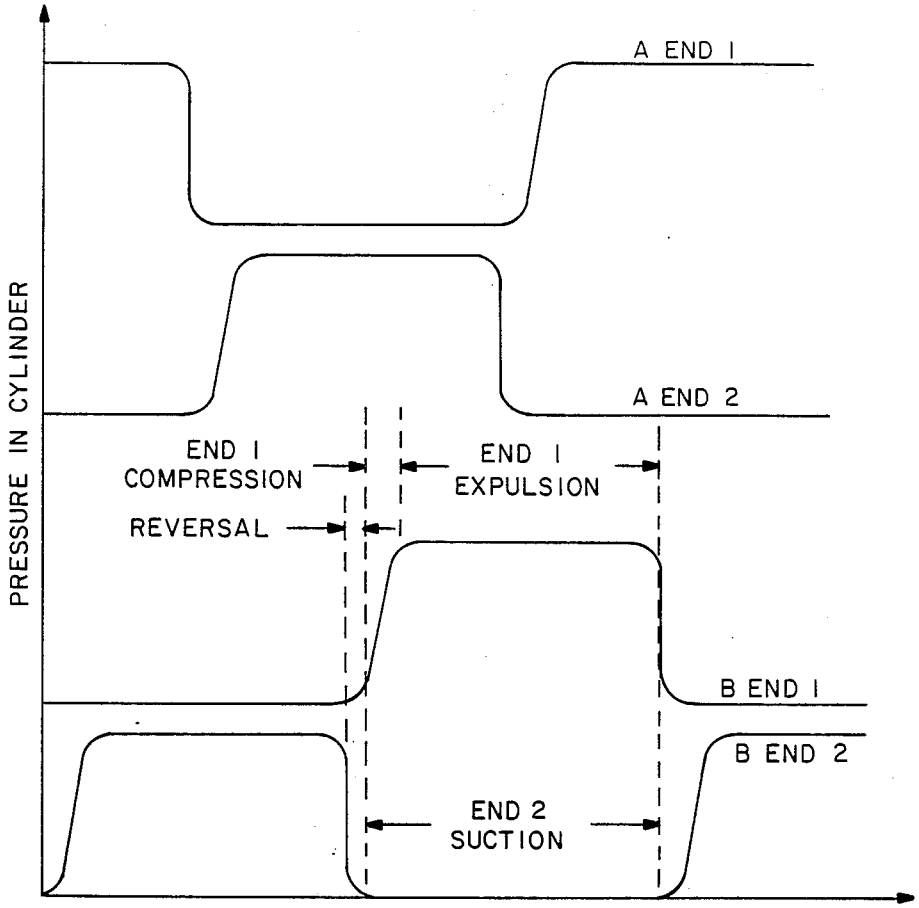
Figure 9:
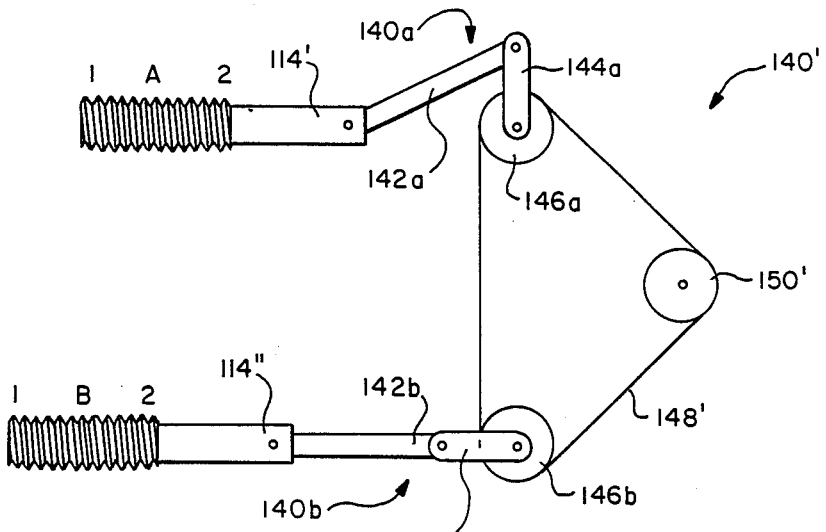
Figure 10:
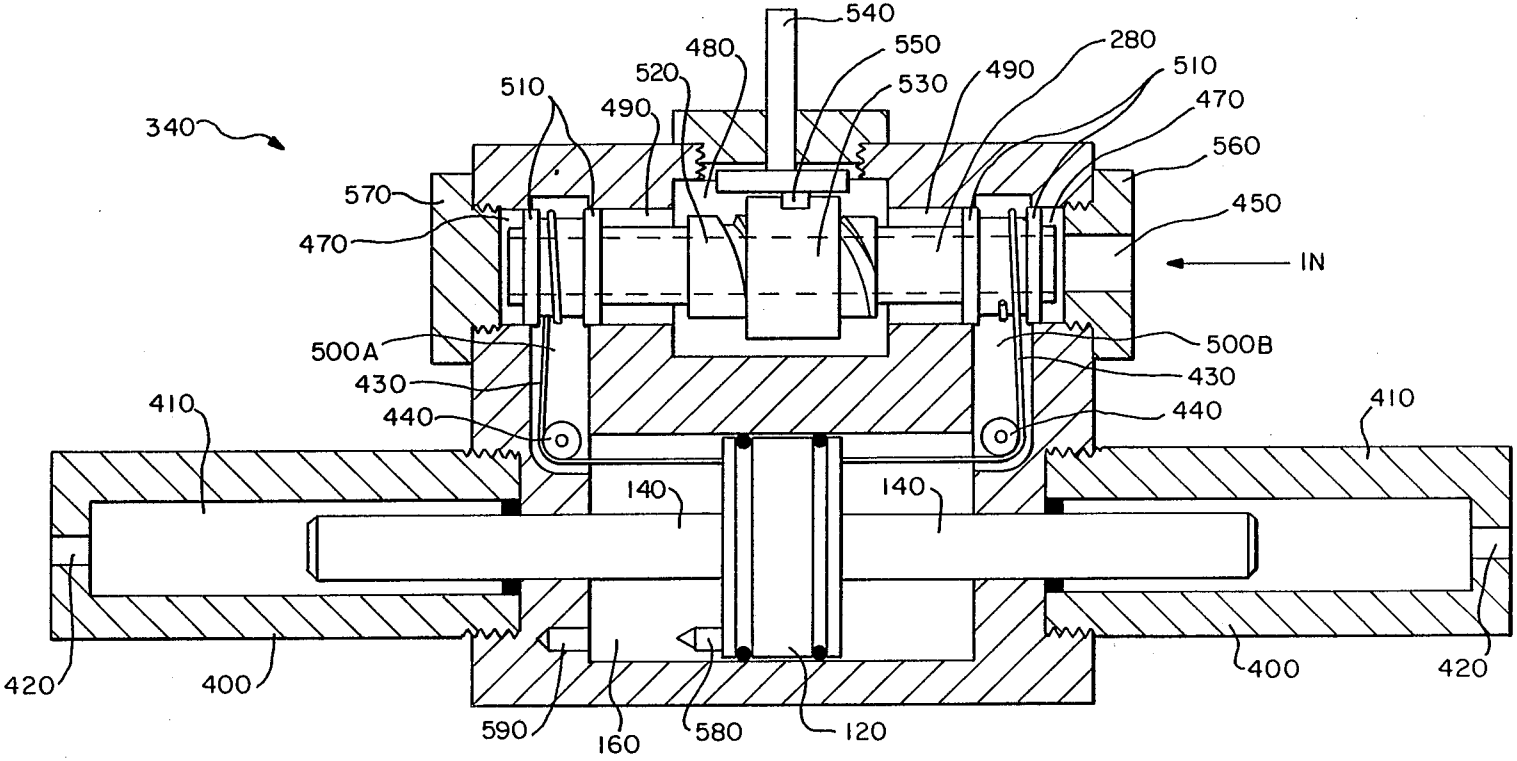

FIG. 8 graphically illustrates pressure output of two intensifiers connected together in accordance with the present invention;

FIG. 9 is a diagrammatic illustration of a control arrangement coupled with the intensifiers of the assembly of FIG. 10A for controlling the movement of the intensifiers pistons in accordance with the present invention;

FIG. 10 diagrammatically illustrates an overall feedback type of intensifier designed in accordance with a second embodiment of the present invention; and FIG. 11 is a diagrammatic illustration of a coupling for two intensifiers of the type illustrated in FIG. 10.

Figure 1:
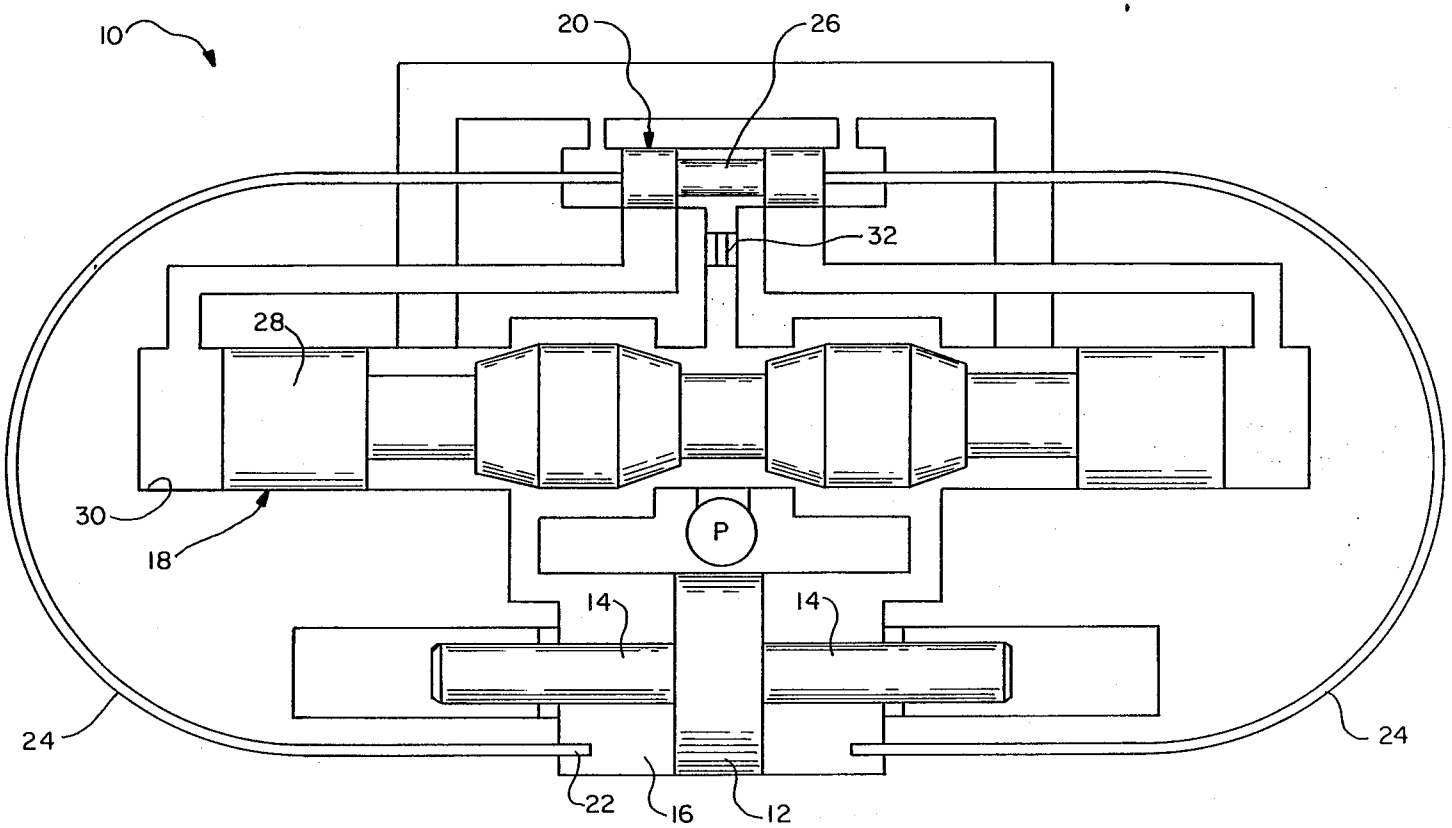
Figure 2:
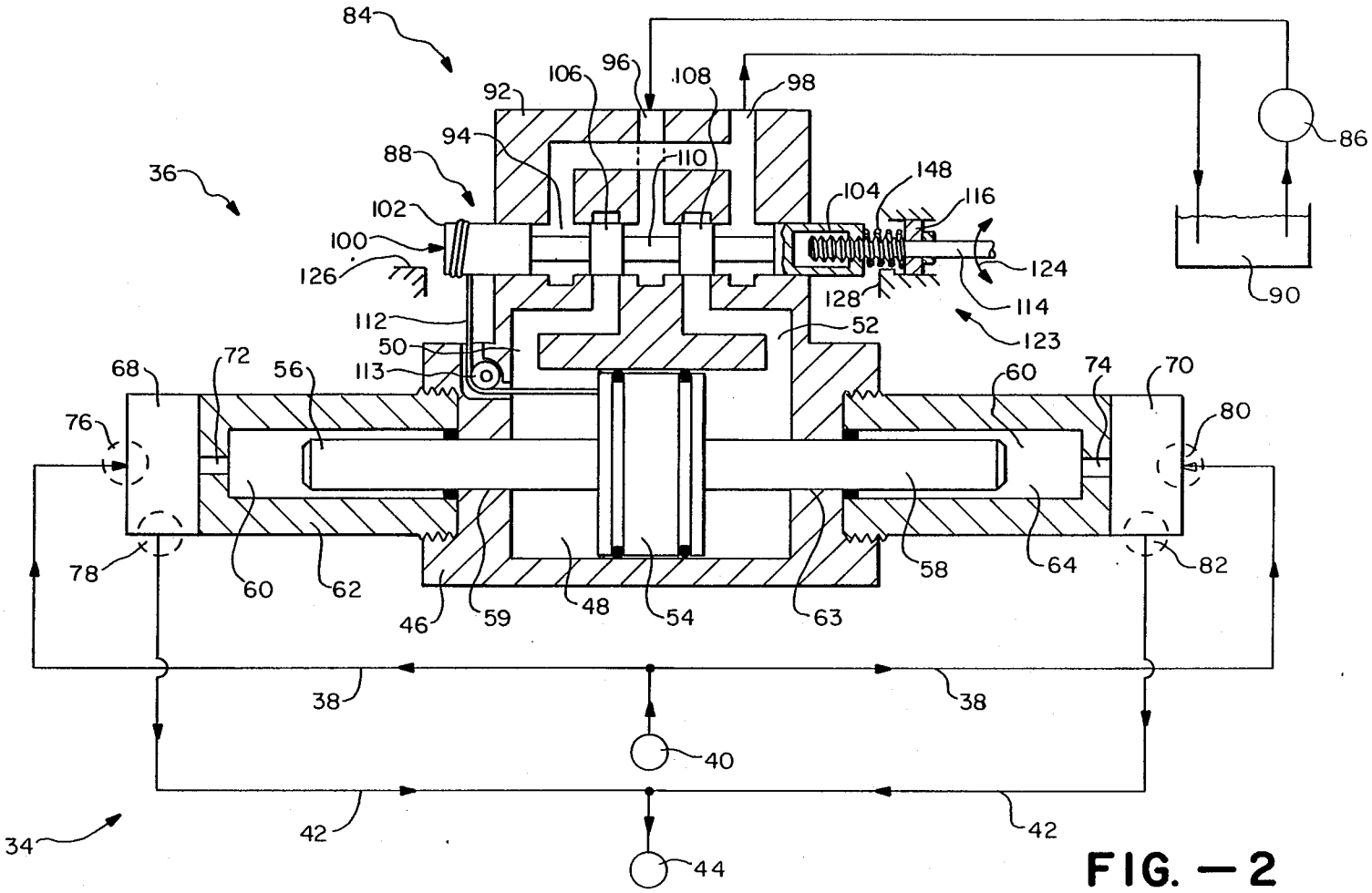
Figure 3:
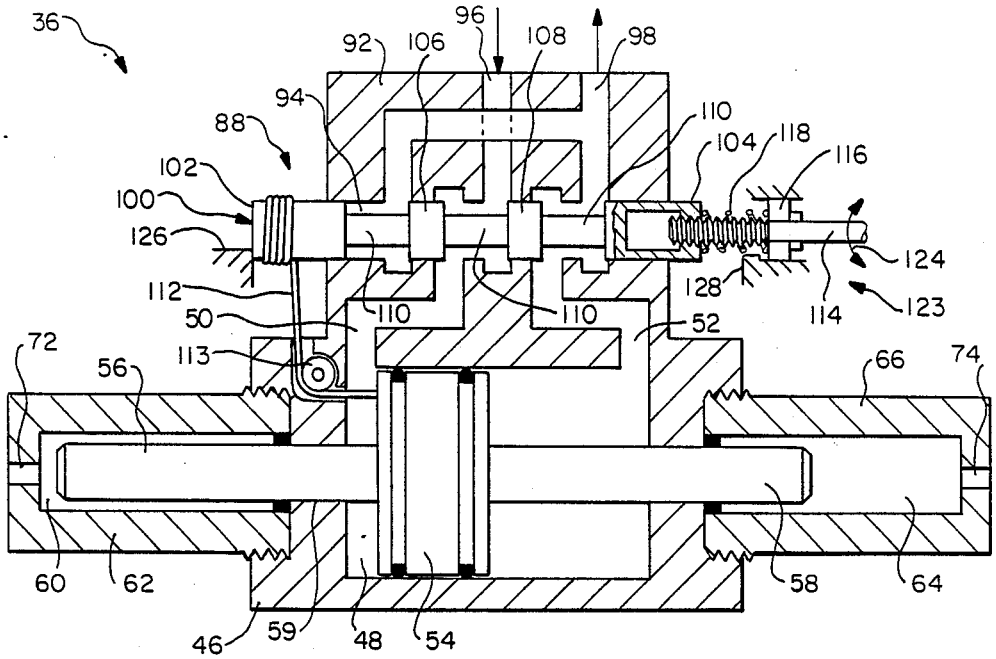
Figure 4:
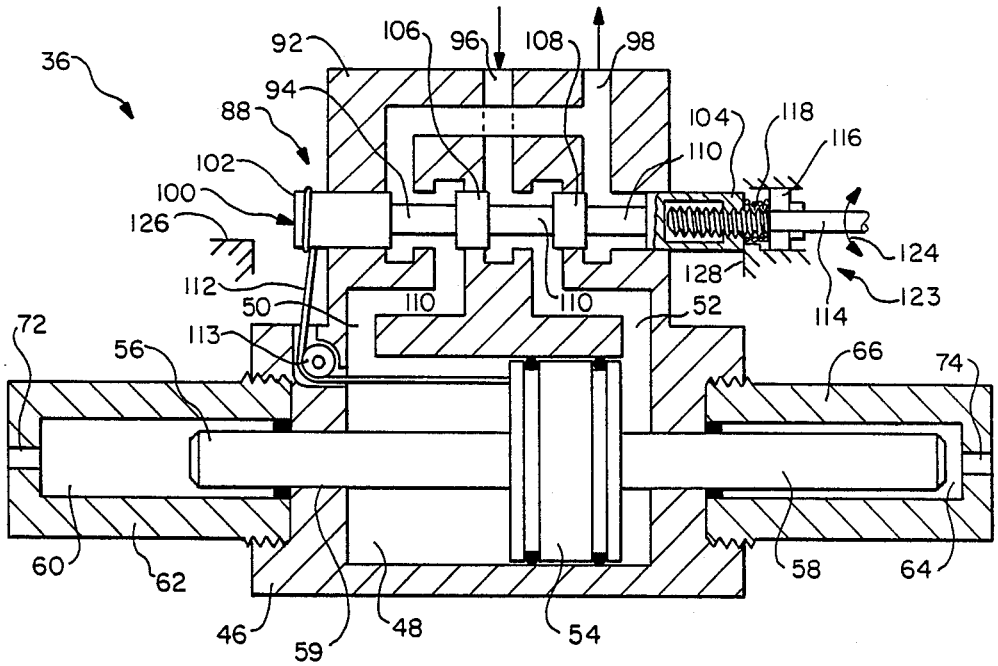

Turning now to the drawings, wherein like components are designated by like reference numerals throughout the various Figures, attention is immediately directed to FIGS. 2, 3 and 4 since FIG. 1 was discussed previously. FIG. 2 diagrammatically illustrates an assembly generally indicated at 34 for pumping fluid, which for purposes of description will be assumed to be water, at high pressure, for example at 12,000 psi or higher. This assembly is shown including an intensifier 36 designed in accordance with the present invention, means generally indicated by the arrows 38 for making the water to be pumped available to the intensifier from a source generally indicated at 40 and means generally indicated by arrows 42 for directing the pressurized pump water from the intensifier to a desired location generally indicated at 44.

Still referring to FIG. 2 in conjunction with FIGS. 3 and 4, the intensifier 36 is shown including a cylinder housing 47 defining an axially extending cylinder chamber 48 and axially spaced apart inlet/outlet drive ports 50 and 52, respectively, located at opposite ends of the cylinder chamber. A piston 54 is mounted within chamber 48 for reciprocating movement between the inlet/-outlet ports 50 and 52 in the manner to be described hereinafter. As illustrated in FIGS. 2–4, the piston carries co-axial plungers 56 and 58 extending in opposite directions on opposite sides of the piston. The plunger 56 extends through a cooperating opening 59 in cylinder housing 46 and into a pumping chamber 60 defined by a plunger housing 62. In a similar manner, plunger 58 extends through a cooperating opening 63 into a pumping chamber 64 defined by a plunger housing 66. Pumping chambers 60 and 64 are respectively connected in fluid communication with valve heads 68 and 70 through fluid ports 72 and 74 extending through the plunger housings. For reasons to be discussed immediately below, the valve head 68 includes inlet and delivery check valves 76 and 78, respectively, and valve head 70 includes inlet and delivery check valves 80 and 82, respectively.

Overall intensifier 36 includes an arrangement 84 to be discussed in detail below for causing piston 54 to reciprocate back and forth between ports 50 and 52, as best illustrated in FIGS. 3 and 4. Assuming for the moment that the piston is initially positioned adjacent to inlet/outlet port 50 as shown in FIG. 3 and is caused to move to inlet/outlet port 52 as shown in FIG. 4, this causes plunger 56 to move through pumping chamber 60 in a direction away from valve head 68 while, at the same time, plunger 58 is caused to move in its pumping chamber in a direction toward valve head 70. As the plunger 56 moves away from valve head 68, check valve 76 is maintained opened while check valve 78 is closed. This causes water from source 40 to be drawn into the valve head and ultimately into pumping chamber 60. At the same time, the inlet check valve 80 is maintained closed while the outlet check valve 82 is opened. Thus, as the plungers 58 moves toward valve head 70, water within pumping chamber 68 is caused to flow out through orifice 74, valve head 70 and check valve 82 to the desired location 44 in a pressurized manner.

For purposes of description, movement of the plunger 56 in the manner just described may be referred to as an intake stroke since it causes water to be taken into the pumping chamber 60 while movement of the plunger 58 may be referred to as an output stroke since it functions to expel water in a pressurized manner from pumping chamber 64. Movement of the piston in the opposite direction, that is, from its position illustrated in FIG. 4 adjacent port 52 to its FIG. 3 position adjacent to inlet/outlet port 50 causes the plunger 56 to move through an output stroke while plunger 58 moves through an intake stroke. Check valve 76, 78 and 80, 82 are controlled by suitable means (not shown) in order to open and close at the appropriate times discussed above.

Drive arrangement 84 is shown including a drive pump 86 for providing a supply of drive fluid under pressure, for example, oil, and a control device 88 for directing pressurized drive fluid from supply 86 into cylinder chamber 48 alternatively through each of the inlet/outlet ports 50 and 52 while maintaining the other of these ports in fluid communication with a sufficiently low pressure environment, for example a reservoir 90 of drive fluid, which is suitably coupled back into the input of pump 86, as illustrated specifically in Figure 2. This, in turn, causes piston 54 to move away from the port receiving the pressurized fluid, for example the port 50 in FIG. 3 and the port 52 in FIG. 4, and towards the other port. Therefore, in order to reciprocate piston 54 between its two extreme positions in FIGS. 3 and 4, the inlet/outlet ports 50 and 52 are alternately opened to the supply of pressurized fluid from pump 86 while the other inlet/outlet port is simultaneously opened to revervoir 90. As will be seen below control device 88 in combination with an actuating mechanism to be described accomplishes this while, at the same time, monitoring the position of piston 54 throughout its reciprocating motion within cylinder chamber 48.

Still referring to FIGS. 2–4, control devices 88 which, as will be seen, functions as a four way control valve includes a valve housing 92 defining an opened ended valve chamber 94 in fluid communication with the previously recited inlet/outlet ports 50 and 52, an inlet passage 96 placing the pressurized fluid from supply pump 86 in fluid communication with the valve chamber and an outlet passage 98 placing the valve chamber in fluid communication with reservoir 90.

Control device 88 also includes a control valve or spool 100 including cylindrical end sections 102 and 104 and intermediate cylindrical stops 106 and 108 interconnected by reduced cylindrical sections 10. The control spool can be of the shape illustrated in FIGS. 2–4 or any other suitable shape which will be satisfactory for the desired operation of the overall control device. In any case, the control valve or spool is mounted within valve chamber 94 for rotation about its own axis and, at the same time, for reciprocating movement between a first extreme position for opening inlet/outlet ports 50 and 52 to drive pump 86 and reservoir 90, respectively, as illustrated in FIG. 3 and an opposite extreme position for reversing these connections between the inlet/outlet ports and the pump and revervoir, as illustrated in FIG. 4. Thus, when the spool is moved to its extreme left as viewed in FIG. 3, pressurized fluid from drive pump 86 is allowed to enter valve chamber 48 behind piston 54 while drive fluid within the valve chamber in front of the piston is placed in fluid communication with reservoir 90, thereby causing the piston to move from its extreme left hand position to its extreme right hand position. In the same way, when the control spool is moved to the far right, as view in FIG. 4, the reverse takes place, thereby causing the piston to move in the opposite direction. During this movement, the check valves 76, 78 and 80, 82 are appropriately opened and closed in the manner discussed above.

It is important to note that as the control spool 100 is moved between its extreme positions, it moves through an intermediate position, as illustrated in FIG. 2, which momentarily closes both inlet/outlet ports 50 and 52 to both the drive pump 86 and reservoir 90. Thus, in order to reverse the direction of piston 54, it is necessary to entirely close the inlet/outlet ports and open them up again. As will be discussed in detail hereinafter, one aspect of the present invention is to control the speed at which this is done in order to control overall operation of the pump assembly so as to mimimize hydraulic shock, eliminate an accumulator in association with the drive pump 86 or to eliminate the necessity to make the drive pump rapidly compensate for the compression segment of each output stroke of the piston.

As indicated previously, control device 88 not only opens and closes the inlet/outlet ports 50 and 52 to pump 86 and reservoir 90 but also continuously monitors the position of piston 54 as it moves through cylinder chamber 48. This is accomplished by interconnecting the piston to the control spool by cable means so that the back and forth movement of the piston between the inlet/outlet ports causes the cable means to rotate the spool about its own axis within the valve chamber 94 in a corresponding manner, whereby the rotational position of the spool at any given time corresponds to the position of the piston within the cylinder housing at that time. In the specific embodiment illustrated in FIGS. 2–4, a single cable 112 is fixedly connected at one end to one side of piston 54 and has its opposite end wrapped around end section 102 of the control spool. A roller 113 supports the cable between its two end positions. At the same time, the other end of the control spool includes an internally threaded, axially extending passage which coaxially receives an externally threaded drive shaft 114 mounted for rotation about its own axis but held fixed against axial movement by suitable means generally indicated at 116. A load spring 118 is disposed between the end section 104 of control spool 102 and means 116. This spring and the thread connection between the control spool and drive shaft are selected such that the urging of the load spring against the control spool causes the latter to want to rotate about its own axis in the direction which will wind cable 112 about end 102, thereby always maintaining the cable taught.

As will be seen hereinafter, drive shaft 114 serves as part of an overall arrangement for controlling the position of spool 100 and thereby controlling movement of piston 54. However, for the moment, let it be assumed that this arrangement has placed the spool in its FIG. 3 position and that the piston begins to move from its center position in FIG. 2 to the right. At the very beginning of the piston's movement, the spool is in a particular rotational position corresponding to the piston's position. As the piston moves to the right, it pulls cable 112 with it, thereby causing the cable to unwind from the spool which, in turn, rotates the spool counterclockwise (as viewed from end section 102) in a manner corresponding to the movement of the piston until the latter reaches its FIG. 2 position and motion stops. This presupposes that the force applied by the cable as a result of the movement of the piston is greater than the reverse torque resulting from load spring 118 and this factor must be taken into account in the design of the overall intensifier. Now, assume for the moment that spool 100 is placed in its FIG. 4 position, causing the piston 54 to move to the left back towards its FIG. 2 position. The cable 112 is then allowed to rewind around the spool, again because of the torque on the spool resulting from spring 118, thereby causing the spool to rotate clockwise (again as viewed from end section 104) back towards its original rotational position. When its FIG. 2 position is once again attained, oil flow is blocked and motion ceases.

Thus, for every position of shaft 114 throughout its movement, there is a unique axial position of piston 54 at which it will come to rest. The mechanism described provides a complete servo-feedback system for controlling the motion of piston 54 by the angular input1 124 of shaft 114. This feedback control could also be accomplished optically or in any other suitable manner without departing from the present invention. While the position of piston 54 is preferably monitored in this way using cable 112, the piston's position could be monitored in other ways, without departing from certain aspects of the present invention not directly connected to the spool. For example, the piston's position could be sensed electronically, optically or by a combination of both, as will be discussed further with respect to FIG. 7.

Referring briefly to FIG. 10 (which will be discussed in more detail hereinafter), this figure diagrammatically illustrates a modified intensifier 340. The position 120 of this intensifier is shown along with a spool 280, and two cables 430 interconnecting the piston and spool rather than just one such cable. The two cables are shown on the opposite side of and opposite fixedly connected to the piston and would around end sections of the control spool 280. The second cable replaces load spring 118. More specifically, as the piston moves from its left to its right as viewed in FIG. 10, one of the cables is caused to unwind from the spool while the other winds around it. As the piston moves from its right to its left the reverse is true. This dual action not only eliminates the necessity to include the load spring 118 but also has been found to eliminate a sticking problem resulting from the use of the load spring. Other features of intensifier 340 will be discussed hereinafter.

Returning to FIGS. 2–4, it should be noted that the cable 112 extends from within piston chamber 48 to the ambient surroundings where it is wound around control spool 100. This requires means not illustrated in FIG. 2 for suitably sealing the passageway in valve housing 46 around the cable as it leaves the valve housing. While this can be accomlished by suitable means, in accordance with another aspect of the present invention, the necessity of such a seal is eliminated, as will be seen hereinafter in the discussion of the intensifier 340 illustrates in FIG. 10. For the moment, it suffices to say that this latter intensifier includes the two cables 430 discussed immediately above, both of which are located within the hydraulic drive circuit of the intensifier and never exit to the ambient surroundings. In this way, it is not necessary to provide any type of exit seals.

As indicated above, intensifier 84 includes an arrangement generally indicated at 123 (see FIG. 2) for actuating movement of spool 100 between its two extreme positions and drive shaft 114 comprises part of that arrangement. Means for rotating the drive shaft about its own axis can also comprise part of that arrangement, as generally indicated by the double arrow 124. In order to explain how this arrangement operates, it will be assumed that the intensifier is initially in a static, non-pumping condition with its piston 54 and spool 100 in the positions illustrated in FIG. 2. Note specifically that the piston is centrally located within piston chamber 48 and spool 100 is in a similar position in its valve chamber 94, thereby closing off inlet ports 50 and 52. With the intensifier in this condition, in order to drive the piston to the right as viewed in FIG. 2, the shaft 114 must be rotated in the appropriate direction, for example counterclockwise as viewed from the spool into the shaft, in order to cause the spool to thread out from the shaft and thereby move to the left. As soon as the spool begins moving to the left, the two ports 50 and 52 open and the pressurized fluid from pump 86 begins to move the piston to the right, somewhat slowly because the inlet/outlet ports are not fully opened immediately. At the same time, the cable 112 causes the spool to rotate in the same direction as the drive shaft, that is, counterclockwise, thereby causing the spool to want to move to the right. So long as the rotational speed of drive shaft 114 is greater than the rotational speed of the spool, the spool will continue to move to its left until it engages a fixed stop 126 forming part of the overall intensifier. At that time, the spool is in its extreme left hand position and the inlet/outlet ports are entirely opened. At the same time, the piston continues to move it its right, thereby causing the spool to continue rotating counterclockwise. At that time, counterclockwise rotation of the drive shaft can be terminated, in which case the continued rotation of the spool will cause the latter to move back to the right to its initial position closing the inlet/outlet ports. The interrelationship between movement of the piston and spool is such that the inlet/outlet ports are closed at the time the piston moves to its right hand position as viewed in FIG. 4. Without further action on the drive shaft 114, the intensifier operation comes to a stop.

In order to move the piston back to its central position, the drive shaft is caused to rotate in the opposite direction, for example clockwise, causing the spool to move to the right, as viewed in FIG. 4, thereby opening the inlet/outlet ports in order to move the piston to the left. So long as the rotational speed of the drive shaft is greater than the rotation of the spool caused by the piston movement, the spool will move all the way to the right against a second fixed stop 128. If at that time the rotation of the drive shaft is terminated, thereby closing the inlet/outlet ports at the time the piston reaches its center point. In order to move the piston all the way to the left, the drive shaft must again be rotated clockwise sufficient to move the spool back to the right thereby causing the piston to move further to the left and thus drive the piston back to its center position.

The action just described presupposed a step-wise operation of the intensifier 84. However, it is possible to rotate drive shaft 114 in a way which provides continuous reciprocating movement of piston 54 within piston chamber 48. In order to understand how this occurs, let it be assumed that the piston is initially in its extreme left hand position, as viewed in FIG. 3, and that the drive shaft is rotated sufficiently fast in its counterclockwise direction to drive the spool to the left against stop 126. At this time, the piston is starting to move to the right, thereby causing cable 112 to unwind from the spool. So long as counterclockwise rotation of the drive shaft is equal in speed to the counterclockwise rotation of the spool caused by the cable, the spool will remain axially stationary against stop 126, thereby keeping the inlet/outlet ports in their fully opened conditions. By this rotational action of the drive shaft, the spool can be maintained in its extreme left hand position until the piston reaches its exteme right hand position of FIG. 4 which can be sensed by the rotational position of the control spool, as described previously. Note that this rotational movement of the drive shaft is thus limited by and is a function of the movement of the piston since movement of the latter is responsible for rotation of the spool. Once the piston reaches its extreme right hand position, the drive shaft can be made to reverse in rotation in order to move the spool from its extreme left hand position illustrated in FIG. 3 to its extreme right hand position as illustrated in FIG. 4, thereby reversing the operation of intensifier 84. This procedure can be repeated over and over again in order to cause the piston to continuously reciprocate. Suitable means can readily monitor the axial position of the spool and its rotational position in order to appropriately control the direction and speed of drive shaft 114.

Figure 5A:
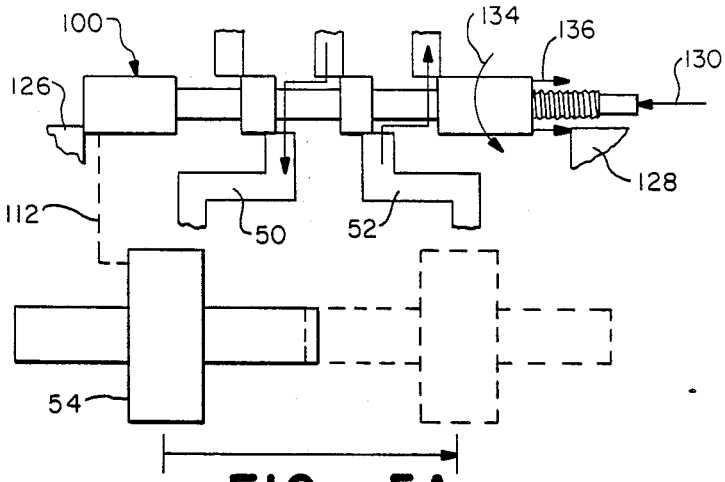
Figure 5B:
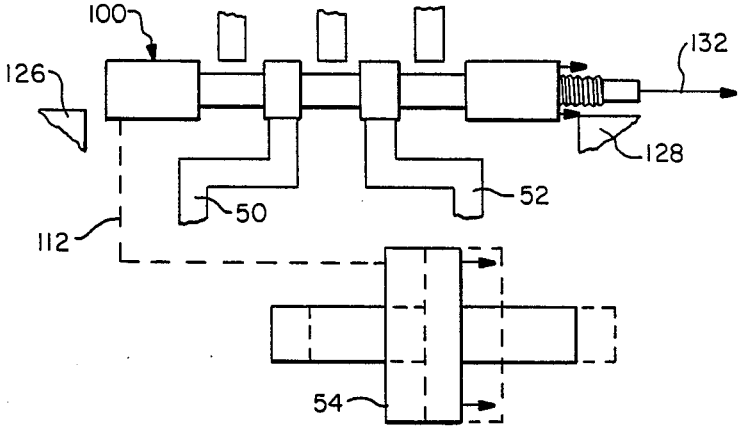
Figure 5C:
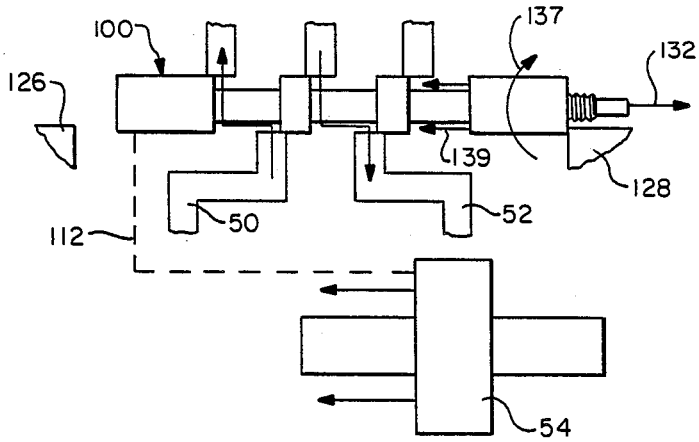

The operational description of actuating arrangement 123 is based on rotational movement of the drive shaft 114. In another embodiment of the actuating arrangement, as illustrated in FIGS. 5A–5C, an actuating arrangement 123' is shown in which the drive shaft is not rotated but rather moved axially towards and away from the control spool by suitable means generally indicated by the back and forth arrows 130 and 132. FIG. 5A diagrammatically illustrates the piston 54 initially at its extreme left hand position while the spool is moved axially to the left against stop 126, as indicated by arrow 130. This causes the inlet/outlet ports to open entirely, thereby causing the piston to begin moving to its right. This in turn, causes the spool to rotate counterclockwise as indicated by arrow 134, thereby causing the spool to thread over drive shaft 114 in the right hand direction, as indicated by arrows 136. So long as the drive shaft is continuously urged to the left and the same speed that the spool wants to move to the right (which is dependent upon the speed of the piston), the spool will remain engaged against stop 126 and the inlet/outlet ports will remain entirely open. Thus, the control spool 100 can be maintained in its FIG. 5A position until the piston reaches its extreme right hand positon. At that time, the drive shaft can be pulled from its extreme left hand position towards its extreme right hand position, as indicated by arrow 132 in FIG. 5B. Note that during this action, the spool crosses the inlet/outlet ports, momentarily closing the latter. Once the spool crosses over the inlet/outlet ports, the piston begins moving to the left as seen in FIG. 5C, causing the spool to rotate in the opposite direction as indicated by arrow 136 and therefore moving off of the threaded drive shaft to the left as indicated by arrows 139. At the same time, the spool is moved at a faster rate to the right until it engages stop 128. At that time, movement to the right of the drive shaft is made to be equal to the movement of the spool to the left over the drive shaft, thereby maintaining the spool in the extreme right hand position against stop 128. The spool is maintained in this position until the piston reaches its extreme left hand position and the entire procedure may be repeated, thereby causing the piston to move back and forth within chamber 48.

It should be arrarent from the description immediately above that by controlling the reciprocating movement of drive shaft 114 relative to the movement of spool 100, the axial position of the spool can be controlled relative to the position of the piston. For example, the spool can be made to remain to the extreme left or the extreme right throughout the movement of the piston between its extreme positions in order to keep the inlet/outlet ports fully open as described and then the spool can be quickly moved between its extreme positions as quickly as possible in order to mimimize the amount of time that the inlet/outlet ports remain entirely closed. On the other hand, the axial movement of the spool can be controlled so as to, for example, throttle the inlet/outlet ports, that is, open them slowly. As will be seen hereinafter, this is especially desirable when two intensifiers are utilized to make up an overall pump assembly. More specifically, each time piston 54 moves from one extreme position to the other, one of its plungers 56 or 58 moves through an output stroke in its pumping chamber. As it does so, it first must compress the water or other such fluid in its pumping chamber to a sufficient degree before the fluid being pumped can be expelled from the chamber. For example, in the case of water, when the plunger begins its stroke, the water in the pumping chamber is at about 100 psi in an actual working embodiment. In the same embodiment, the plunger must move about one-eighth of a stroke before the pressure builds to the outlet pressure of, for example, 60,000 psi. Thus, the output stroke can be divided into two segments, an initial compression segment and an expulsion segment, As will seen hereinafter with respect to the assembly which includes two intensifiers, these intensifiers are operated so that the inlet/outlet ports associated with a given intensifier are always opened slowly, that is, throttled, during the compression segment of the output stroke. In the case of actuating arrangement 123 or 123', this can be readily carried out by controlling the axial position of the spool with respect to the movement of the piston.

Figure 6:
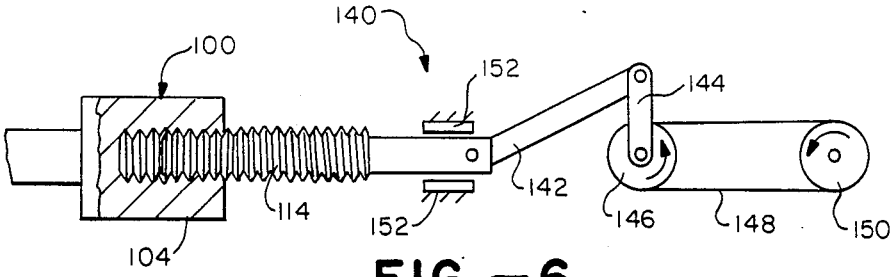
FIG. 6 illustrates a control arrangement coupled with the intensifier of FIG. 2 in order to move the intensifier piston in a controlled manner.

Actuating arrangement 123' has been described as including the externally threaded drive shaft 114 and suitable means not shown for moving the drive shaft axially, as indicated by the arrows 130 and 132. One such mechanism for accomplishing this is illustrated in FIG. 6. This mechanism which is generally indicated by the reference numeral 140 includes a pair of rigid links 142 and 144 pivotally connected to one another at common ends. At the same time, the link 142 is pivotally connected to the otherwise free end of drive shaft 114 at its opposite end while the otherwise free end of link 144 is fixedly mounted to a rotatable member 146 which, when rotated, causes the link to rotate in a crank-like fashion. Member 146 is driven through a continuous drive belt 148 by means of a motor 150. At the same time, the drive shaft 114 is limited to axial movement by suitable track means generally indicated at 152. Thus, rotational movement of link or crank 144 about the center point of member 146 causes the drive shaft 114 to reciprocate back and forth along its own axis. Motor 150 can be of a variable speed type, it can be a constant torque motor, a stalling motor or any other suitable type of motor in order to control the movement of drive shaft 114 with respect to movement of the piston 54 in order to provide the desired movement of control spool 100. While any suitable means can be provided to move the drive shaft back and forth in a controlled manner, mechanism 140 has been illustrated in particular because it forms part of a more complicated mechanism to drive a dual intensifier assembly, as will be described in detail hereinafter.

Still referring to mechanism 140, it will be recalled that one type of movement of drive shaft 114 requires that the latter move axially at a speed equal to and in a direction opposite to that of the control spool 100 if the latter is to be maintained in a position against one of the stops 126, 128, as the piston 54 moves. Thus, using mechanism 140 to accomplish this, in order for it to maintain the spool fixed against one of the stops, the rotational movement of crank 144 is limited to the necessary movement of the drive shaft and hence so is endless belt 148. Therefore, under these conditions, movement of the belt 148 is limited by movement of the piston itself and therefore it is important that the motor 150 be capable of stalling or otherwise compensate for this situation.

Figure 7:
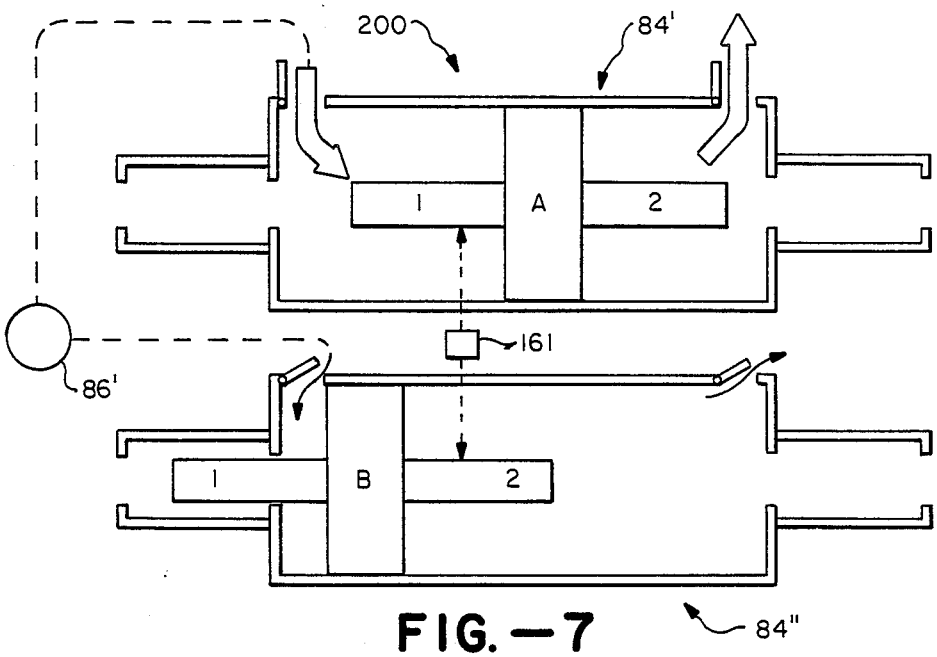
FIG. 7 is a diagrammatic illustration of an overall pump assembly utilizing two intensifiers of the type illustrated in FIGS. 2 and 7–9.

Turning now to FIG. 7, this Figure diagrammatically illustrates an overall pumping assembly 200 including two intensifiers 84' and 84'' corresponding in most respects to previously described intensifier 84. While not shown, the two intensifiers 84' and 84'' have their valve heads interconnected to a single source of fluid to be pumped, corresponding to previously recited source 40, and to a desired location for the fluid to be pumped to, corresponding to previously recited location 44. The two pistons forming parts of the two pumps for purposes of description will be designated as pistons A and B and their respective plungers will be identified by the numbers 1 and 2. A single drive pump 86', corresponding to drive pump 86, is utilized to drive pistons A and B and, while not shown, a single reservoir corresponding to reservoir 90 is also utilized. While not shown, each of the intensifiers 84' and 84'' may include its own control device corresponding to device 88 utilizing a rotationally and axially movable control spool corresponding to spool 100. In this way, the pistons A and B are reciprocated back and forth such that one of the plungers of each piston is caused to move through an intake stroke while its other plunger moves through an output stroke, the latter including both a compression segment and an expulsion segment as described previously.

In accordance with still another aspect of the present invention, suitable means are provided for controlling the movement of the control spools forming parts of the two intensifiers 84' and 84'' in order to cause their respective pistons to reciprocate back and forth through their intake and output strokes in fixed phased relationship with one another so as to maintain the following relationships. First, a given piston of at least one of the pumps is always in its expulsion segment of its output stroke with respect to a pumping chamber of that pump during operation of the overall assembly and, second, the inlet/outlet port receiving pressurized drive fluid to move the last mentioned piston is maintained in a fully opened condition during the expulsion segment of its output stroke. Third, the piston of each of the pumps is moved through the initial compression segment of each of its output strokes by maintaining the inlet/outlet port receiving pressurized drive fluid to provide the last mentioned movement in only a partially opened or throttled condition throughout the compression segment of the stroke so as to slowly meter the pressurized fluid through the partially opened port. This interrelationship between the two pistons is best illustrated in FIG. 8. FIG. 7 diagrammatically illustrates piston A of intensifier 84' moving through the expulsion segment of its output stroke. Note that the inlet/outlet ports are fully opened at that time, as diagrammatically illustrated. At the same time, piston B of intensifier 84'' is shown moving through the compression segment of its output stroke. Note that the inlet/outlet ports are throttled.

The interrelationship between intensifiers 84' and 84'', as described immediately above, makes it possible to use a single drive pump without the need for an accumulator and the drive pump itself is not required to rapidly compensate for transients occurring during the compression segment of each output stroke. Moreover, hydraulic shock is minimized.

The two intensifiers 84' and 84'' were described including control devices utilizing control spools corresponding to previously described spools 100. It is to be understood that the control arrangement used to control the position of each of the pistons A and B is not limited to such a control device but could be of any other suitable type capable of controlling the pistons in the desired manner. For example, electrical or electro-optical means generally indicated at 161 in FIG. 7 can be used to sense the position of each piston and provide suitable feedback signals to control their movement by opening and closing the inlet/outlet ports in the appropriate manner. However, assuming that the intensifiers 84' and 84'' include control arrangements corresponding to previously describe device 88, a suitable actuating arrangement is necessary to move their associated control spools in the proper manner. One such actuating mechanism is illustrated in FIG. 9 at 140'. This mechanism includes two identical sub-mechanisms **140*a* and 140*b* which are similar in most respects to the previously described mechanism 140 illustrated in FIG. 6. Thus, the sub-mechanism 140*a* includes corresponding links 142*a* and 144*a* and corresponding rotating member 146*a*. Sub-mechanism 140*b* includes corresponding links 142*b* and 144*b* and a corresponding rotating member 146*b*. The links 142*a* and 142*b* are pivotally connected at their free ends to the free ends of threaded drive shafts 114' and 114" which form part of intensifiers 84' and 84" and which correspond in function to previously described drive shaft 114. The two members 146*a* and 146*b* are driven by a single drive motor 150' corresponding to motor 150 by means of a single endless belt 148' which corresponds in function to drive belt 148 but which drives both of the members 146*a* and 146*b* simultaneously and at the same speed. For reasons to be discussed below, motor 150'** is designed to stall.

The sub-mechanism 140' interconnects the control spools making up intensifiers 84' and 84" such that their respective pistons A and B are 90° out of phase with one another. Moreover, when one of the control spools is driven to its extreme, against a stop by one of the sub-mechanisms, for the entire time that the control spool is maintained in that extreme position, rotational movement of its associated member **146*a* or 146*b* is limited by the movement of the corresponding piston, for the reasons described previously. Thus, for example, if the sub-mechanism 140*b* is acting on its control spool to maintain the latter in position against a stop, as illustrated in FIG. 9, rotational movement of members 144*b* and 146*b* is limited by the movement of the piston associated with that spool. This limits the movement of endless belt 148' and thus limits the movement of link 144*a* and associated member 146*a* to the same movement, thereby ultimately limiting movement of the other control spool. In other words, the feedback action between one of the pistons and its control device (spool) controls the movement of the control spool associated with the other piston. This combined action provides for an uncomplicated and reliable mechanical mechanism for providing the piston relationship illustrated in FIGS. 7 and 8**.

Turning now to FIG. 10 and 11 in conjunction with FIG. 8, attention is directed to a fluid pump assembly 340 which is designed in accordance with an actual working embodiment of the present invention. For purposes of description it will be assumed that the assembly pumps water at high pressure, for example at 10,000 psi or higher. FIG. 10 shows the piston 120 and water pumping plungers 140 operating in cylinders 400 to alternately draw in and expel water from chambers 410. Check valves to produce a pumping action are connected to passages 420 but are existing art and are not shown here. Cables 430 pass over pulleys 440 and at one end are connected to piston 120. The other ends are wound over and fastened to valve spool 280 in such a manner that motion of the piston causes the spool to rotate unwinding cable from one end and rewinding it at the other.

The valve has a pressure inlet port 450 and spool 280 has a longitudinal hole 460 so that chambers 470 are both always at the hydraulic pump output pressure. Chamber 480 is connected to the return line to the hydraulic reservoir or the suction line of the hydraulic pump so that chamber 480 and passages 490 are always at a low pressure. The cables 430 run through passages 500A and 500B which also serve as passages for oil to flow from the valve to act on piston 120. Passages 500A and 500B are sealed from chambers 470 and 480 by valve lands 510.

At the center of spool 280 is a screw 520 which is threaded into nut 530. Nut 530 has a slot across the top which engages crank pin 550 of crank 540. If crank 540 remains motionless in any position, the situation will be as illustrated with lands 510 sealing ports 500A and 500B and all parts will remain motionless. Operation of the device is as follows:

When crank 540 is turned, it moves spool 280 say rightward. Then lands 510 uncover ports 500A and 500B permitting oil to flow from pressure chamber 47 into passage 500A and from passage 500B to the return line through chamber 480. This causes piston 120 to move rightward and the cables to rotate the spool. As the spool rotates, screw 520 causes it to move leftward in nut 53 then closing ports 500A and 500B once again. The net result is that piston 120 is caused to follow the motion of nut 530.

However, if the speed of piston 120 is limited, say by the oil flow available or by the resistance of flow of the water being pumped, it is possible for the spool 280 to be driven against end plug 570 or inlet port 560. In this case the valve is held full open and the motion of nut 530 and crank 540 is limited by the speed of piston 120 as it causes the spool 280 to rotate permitting the nut 530 to move along the screw 520.

Thus, the valve can function in two modes:

1. As a throttling valve when the nut moves slowly relative to the piston and the piston speed is determined by the speed of the nut.
2. As a fully open valve where the speed of the nut is governed by the motion of the piston.

As explained below, two intensifiers may be connected so that one is operating in each mode at any given time.

Before discussing operation of multiple intensifiers, some further points regarding operation of one must be clarified. First, the throw of the crank 540 is chosen so that when crank pin 550 is at its extreme left or right positions in FIG. 10, the piston 120 is also at its respective left or right hand position. This crank throw dimension is dependent on the pitch of screw 520, the diameter of spool 280 on which the cable winds, and the stroke of piston 120 and may be easily calculated.

Still another aspect of the present invention resides in the recognition that the piston 120 has a tendency to rotationally drift small amounts as it moves back and forth within chamber 160 and the provision for means for eliminating such drift. Specifically, as illustrated in FIG. 10, the piston 120 is provided with a tapered pin 580 designed to engage a cooperating hole 590 in the end of the piston housing. As a result, at the end of every second stroke of the piston, the latter is rotated back to its zero position, thereby eliminating rotary drift.

In practice it has been found necessary to reduce friction to a minimum in the apparatus by using a ball bearing screw and nut and ball bearing thrust bearings where spool 280 contacts plug 570 and inlet 560. Further, it has been found useful to choose a high pitch for screw 52 so that the force exerted by the crank pin 550 causes the screw to rotate. The cables 430 then serve as brakes to the rotation rather than providing the driving force resulting in a much improved operation.

FIG. 11 is a top view looking downward on two cranks 540A and 540B and a drive sprocket 610. The nuts 530A and 530B are also shown but the remainder of the mechanism of FIG. 10 is omitted for simplicity. The crank pins are held 90° out of phase as shown and are driven by chain 600 connecting them to drive motor sprocket 610.

Drive sprocket 610 is driven with a limited torque but with speed sufficient to push one of the two valve spools against the end stop 560 and 570 in FIG. 10. The speed of rotation of drive sprocket 610 is then set by the speed of the piston 120 as previously explained. In FIG. 11 it is the A intensifier that limits the speed since crank 540B is passing top dead center and imparting no motion to nut 530B. As crank 540B moves past top dead center, the speed of nut 530B slowly increases with the intensifier B operating in the throttling mode as described above. At the 45° point intensifier B has completed its compression phase and the two intensifiers are now moving at the same speed. Beyond 45°, intensifier B is in the full open mode and the speed of sprocket 61 is now governed by the speed of piston B. Piston A meanwhile throttles to a stop and smoothly reverses direction as crank pin 550A passes bottom dead center. The process now repeats with intensifier A performing as B did previously.

The pressure signatures resulting from this motion are shown in FIG. 8. We see that at least one cylinder is always at full pressure delivering fluid to the load. Both input and output flows are relatively smooth, although some extra flow is demanded from the hydraulic pump during each compression phase. However, a moderately sized pressure compensated pump will deliver this flow without steep transients because of the throttling on compression.

The foregoing has been a discussion of an overall pump assembly using two pumps, each of which includes a drive piston movable within its own cylinder housing through alternating intake and output strokes between spaced-apart inlet/outlet ports. During the time that one of the pistons is moving through the expulsion segment of its output stroke at full power (with its inlet port fully opened), this movement of the piston limits the movement of the other piston (e.g., the throttled piston) using the control arrangement shown in either FIGS. 9 or 11. While, not shown, if the overall assembly were to include more than two pumps including at least one being driven at less then full power (e.g., throttled); movement of the throttled piston would be limitied by the slowest of those pistons moving at full power.

What is claimed is:

1. A fluid actuated pump, comprising (a) means defining a cylinder housing and first and second spaced-apart inlet/outlet drive ports in fluid communication with said housing;

(b) a piston mounted within said cylinder housing for reciprocating movement between said inlet/outlet ports;

(c) drive means including a supply of fluid under pressure and control means for directing pressurized fluid from said supply into said cylinder housing alternatively through each of said first and second inlet/outlet ports while maintaining the other of said ports in fluid communication with a sufficiently low pressure environment to cause said piston to move away from the port receiving said the pressurized fluid and towards the other port;

(d) a control valve forming part of said control means and including (i) means defining a valve housing in fluid communication with said first and second inlet/outlet ports, said supply of pressurized fluid, and said low pressure environment, and (ii) a valve spool mounted within said valve housing for reciprocating movement between a first extreme position for opening said first and second inlet/outlet ports to said supply of pressurized fluid and said low pressure environment, respectively, a second extreme position for opening said second and first inlet/outlet ports to said supply of pressurized fluid and said low pressure environment, respectively, and a third intermediate position for closing both of said inlet/outlet ports to said supply and low pressure environment;

(e) means forming part of said control means for monitoring the position of said piston as it moves back and forth between said first and second inlet/-outlet ports; and (f) valve actuating means forming part of said control means and responsive to the position of said piston within said cylinder housing for (i) maintaining said spool fixed in its first position for at least a part of the time it takes for said piston to move from said first inlet/outlet port to said second inlet/outlet port, (ii) moving said spool from its first position across said third position and to said second position when said piston reaches said second port from said first port, (iii) maintaining said spool fixed in its second position for at least a part of the time it takes for said piston to move from said second port to said first port, and (iv) moving said spool from its second position across said third position and back to said first position when said piston reaches said first port from said second port;

(g) said valve spool being mounted within said valve housing for rotation about its own axis and said position monitoring means including cable means interconnecting said piston with said spool such that the back and forth movement of said piston between said inlet/outlet ports causes said cable means to rotate said spool about its own axis in a corresponding manner, whereby the rotational position of said spool at any given time in the operation of the pump corresponds to the position of said piston within said cylinder housing at that time.

2. A pump according to claim 1 wherein said valve actuating means includes first means coupled with said spool in a way which causes the rotation of said spool by said cable means to want to move the spool axially within said valve housing in the direction which will close the inlet/outlet port receiving the pressurized fluid and second means acting on said first means in order to prevent said spool from moving axially within said valve housing without inhibiting its rotational movement so long as said piston is moving from one of said inlet/outlet ports to the other.

3. A pump according to claim 2 wherein said first means includes shaft means thread connected in coaxial relationship with one end of said spool and said second means includes means for rotating said shaft means about its own axis relative to said spool in a controlled manner.

4. A pump according to claim 2 wherein said first means includes shaft means thread connected in coaxial relationship with one end of said spool and said second means includes means for moving said shaft means and said spool axially in a controlled manner.

5. A pump according to claim 1 wherein said cable means includes first and second separate cables interconnecting said piston with said spool such that the back and forth movement of said piston between said inlet/outlet ports causes said cables to alternatively wind around and unwind from said spool as the latter is caused to rotate in the manner corresponding to the back and forth movement of said piston.

6. A pump according to claim 1 including means defining a pumping chamber cooperating with one end of said piston and a supply of fluid to be pumped for drawing said pumping into said pumping chamber by the action of said piston moving from said first port to said second port and for expelling said pumping fluid out of said chamber in a pressurized condition by the action of said piston moving from said second port to said first port, said piston moving a particular distance from said second port towards its first port before compressing the pumping fluid sufficient to cause it to be expelled from the chamber, and wherein said spool is maintained fixed in said second position once said pumping fluid is sufficiently compressed to be expelled.

7. A pump according to claim 6 including means defining a second pumping chamber cooperating with the other end of said piston and a supply of fluid to be pumped for drawing said pumping fluid into said pumping chamber by the action of said piston moving from said second port to said first port and for expelling said pumping fluid out of said chamber in a pressurized condition by the action of said piston moving from said first port to said second port, said piston moving a particular distance from said first port towards its second port before compressing the pumping fluid sufficient to cause it to be expelled from the chamber, and wherein said spool is maintained fixed in said first position once said pumping fluid is sufficiently compressed to be expelled.

8. A fluid actuated pump, comprising (a) means defining a cylinder housing and first and second spaced-apart inlet/outlet drive ports in fluid communication with said housing;

(b) a piston mounted within said cylinder housing for réciprocating movement between said inlet/outlet ports;

(c) drive means including a supply of fluid under pressure and control means for directing pressurized fluid from said supply into said cylinder housing alternatively through each of said first and second inlet/outlet ports while maintaining the other of said ports in fluid communication with a sufficiently low pressure environment to cause said piston to move away from the port receiving said the pressurized fluid and towards the other port;

(d) a control valve forming part of said control means and including (i) means defining a valve housing in fluid communication with said first and second inlet/outlet ports, said supply of pressurized fluid and said low pressure environment; and (ii) a valve spool mounted within said valve housing for rotation about its own axis and for reciprocating movement between a first extreme position for opening said first and second inlet/outlet ports to said supply of pressurized fluid and said low pressure environment, respectively, a second extreme position for opening said second and first inlet/outlet ports to said supply of pressurized fluid and said low pressure environment, respectively and a third intermediate position for closing both of said inlet/outlet ports to said supply and low pressure environment, (e) means forming part of said control means for monitoring the position of said piston as it moves back and forth between said first and second inlet/-outlet ports, said position monitoring means including cable means interconnecting said piston with said spool such that the back and forth movement of said piston between said inlet/outlet ports causes said cable means to rotate said spool about its own axis in a corresponding manner, whereby the rotational position of said spool at any given time in the operation of the pump corresponds to the position of said piston within said clinder housing at that time, said cable means being disposed entirely with the hydraulic circuit which interconnects said cylinder housing with said supply of pressurized fluid and said low pressure environment, and (f) valve actuating means for at least moving said spool from said third position to either of its first or second positions.

9. A fluid actuated pump, comprising (a) means defining a cylinder housing and first and second spaced-apart inlet/outlet drive ports in fluid communication with said housing;

(b) a piston mounted within said cylinder housing for reciprocating movement between said inlet/outlet ports;

(c) drive means including a supply of fluid under pressure and control means for directing pressurized fluid from said supply into said cylinder housing alternatively through each of said first and second inlet/outlet ports while maintaining the other of said ports in fluid communication with a sufficiently low pressure environment to cause said piston to move away from the port receiving said the pressurized fluid and towards the other port;

(d) a control valve forming part of said control means and including (i) means defining a valve housing in fluid communication with said first and second inlet/outlet ports, said supply of pressurized fluid, and said low pressure environment, and (ii) a valve spool mounted within said valve housing for rotating about its own axis and for reciprocating movement between a first, extreme position opening said first and second inlet/outlet ports to said supply of pressurized fluid and said low pressure environment, respectively, a second extreme position for opening said second and first inlet/outlet ports to said supply of pressurized fluid and said low pressure environment, respectively and a third intermediate position for closing both of said inlet/outlet ports to said supply and low pressure environment, (e) means forming part of said control means for monitoring the position of said piston as it moves back and forth between said first and second inlet/- outlet ports, said position monitoring means including cable means interconnecting said piston with said spool such that the back and forth movement of said piston between said inlet/outlet ports causes said cable means to rotate said spool about its own axis in a corresponding manner, whereby the rotational position of said spool at any given time in the operation of the pump corresponds to the position of said piston within said cylinder housing at that time, said cable means including first and second separate cables interconnecting said piston with said spool such that the back and forth movement of said piston between said inlet/outlet ports causes said cables to alternatively wind around and unwind from said spool as the latter is caused to rotate in the manner corresponding to the back and forth movement of said piston; and (f) valve actuating means for at least mounting said spool from said third position to either of its first or second positions.

10. A fluid actuated pump, comprising:

(a) means defining a cylinder housing and a piston movable back and forth within said housing between opposite first and second positions; and (b) drive means including a supply of fluid under pressure, a low pressure environment and a hydraulic circuit extending between said supply, said cylinder housing and said low pressure environment for hydraulically causing said piston to move back and forth between said first and second positions within the cylinder housing, said drive means including a control device rotatable about its own axis and cable means disposed entirely within said hydraulic circuit and interconnecting said piston with said control device such that the back and forth movement of said piston between said first and second positions causes said cable means to rotate said control device about its own axis in a manner corresponding to the back and forth movement of the piston, whereby the rotational position of said control device at any point in time in the operation of the pump corresponds to a specific position of said piston along its path of movement.

11. A fluid actuated pump, comprising:

(a) means defning a cylinder housing and a piston movable back and forth within said housing between opposite first and second positions; and (b) drive means for hydraulically causing said piston to move back and forth between said positions within the cylinder housing, said drive means including a control device rotatable about its own axis and cable means interconnecting said piston with said control device such that the back and forth movement of said piston between said first and second positions causes said cable means to rotate said control device about its own axis in a manner corresponding to the back and forth movement of the piston, whereby the rotational position of said control device at any point in time in the operation of the pump corresponds to a specific position of said piston along its path of movement, said cable means including first and second separate cables interconnecting said piston with said control device such that the back and forth movement of said piston between said first and second positions causes said cables to alternatively wind around and unwind from said control device as the latter is caused to rotate in the manner corresponding to the back and forth movement of said piston.

12. A fluid actuated pump, comprising (a) means defining a cylinder housing and first and second spaced-apart inlet/outlet drive ports in fluid communication with said housing;

(b) a piston mounted within said cylinder housing for reciprocating movement between said inlet/outlet ports;

(c) drive means including a supply of fluid under pressure and control means for directing pressurized fluid from said supply into said cylinder housing alternatively through each of said first and second inlet/outlet ports while maintaining the other of said ports in fluid communication with a sufficiently low pressure environment to cause said piston to move away from the port receiving said the pressurized fluid and towards the other port;

(d) a control valve forming part of said control means and including (i) means defining a valve housing in fluid communication with said first and second inlet/outlet ports, said supply of pressurized fluid, and said low pressure environment, and (ii) a valve spool mounted within said valve housing for reciprocating movement between a first extreme position for opening said first and second inlet/outlet ports to said supply of pressurized fluid and said low pressure environment, respectively, a second extreme position for opening said second and first inlet/outlet ports to said supply of pressurized fluid and said low pressure environment, respectively, and a third intermediate position for closing both of said inlet/outlet ports to said supply and low pressure environment;

(e) means forming part of said control means for monitoring the position of said piston as it moves back and forth between said first and second inlet/-outlet ports; and (f) valve actuating means forming part of said control means and responsive to the position of said piston within said cylinder housing for (i) maintaining said spool fixed in its first position for at least a part of the time it takes for said piston to move from said first inlet/outlet port to said second inlet/outlet port, (ii) moving said spool from its first position across said third position and to said second position when said piston reaches said second port from said first port, (iii) maintaining said spool fixed in its second position for at least a part of the time it takes for said piston to move from said second port to said first port, and (iv) moving said spool from its second position across said third position and back to said first position when said piston reaches said first port from said second port;

(g) said valve spool being mounted within said valve housing for rotation about its own axis and wherein said position monitoring means including cable means interconnecting said piston with said spool such that the back and forth movement of said piston between said inlet/outlet ports causes said cable means to rotate said spool about its own axis in a corresponding manner, whereby the rotational position of said spool at any given time in the operation of the pump corresponds to the position of said piston within said cylinder housing at that time; and (h) said valve actuating means including first means coupled with said spool in a way which causes the rotation of said spool by said cable means to want to move the spool axially within said valve housing in the direction which will close the inlet/outlet port receiving the pressurized fluid and second means acting on said first means in order to prevent said spool from moving axially within said valve housing without inhibiting its rotational movement so long as said piston is moving from one of said inlet/outlet ports to the other, said first means including a nut engaging against a cooperating externally threaded section of said spool and a rotatable crank collected with said nut so as to cause the latter and said spool to move axially and wherein said second means includes means for rotating said crank in a controlled way.

13. A fluid actuated pump, comprising (a) means defining a cylinder housing and first and second spaced-apart inlet/outlet drive ports in fluid communication with said housing;

(b) a piston mounted within said cylinder housing for reciprocating movement between said inlet/outlet ports;

(c) drive means including a supply of fluid under pressure and control means for directing pressurized fluid from said supply into said cylinder housing alternatively through each of said first and second inlet/outlet ports while maintaining the other of said ports in fluid communication with a sufficiently low pressure environment to cause said piston to move away from the port receiving said the pressurized fluid and towards the other port;

(d) a control valve forming part of said control means and including (i) means defining a valve housing in fluid communication with said first and second inlet/outlet ports, said supply of pressurized fluid, and said low pressure environment; and (ii) a valve spool mounted within said valve housing for reciprocating movement between a first extreme position for opening said first and second inlet/outlet ports to said supply of pressurized fluid and said low pressure environment, respectively, a second extreme position for opening said second and first inlet/outlet ports to said supply of pressurized fluid and said low pressure environment, respectively, and a third intermediate position for closing both of said inlet/outlet ports to said supply and low pressure environment;

(e) means forming part of said control means for monitoring the position of said piston as it moves back and forth between said first and second inlet/-outlet ports; and (f) valve actuating means forming part of said control means and responsive to the position of said piston within said cylinder housing for (i) maintaining said spool fixed in its first position for at least a part of the time it takes for said piston to move from said first inlet/outlet port to said second inlet/outlet port, (ii) moving said spool from its first position across said third position and to said second position when said piston reaches said second port from said first port, (iii) maintaining said spool fixed in its second position for at least a part of the time it takes for said piston to move from said second port to said first port, and (iv) moving said spool from its second position across said third position and back to said first position when said piston reaches said first port from said second port;

(g) said valve spool being mounted within said valve housing for rotation about its own axis and wherein said position monitoring means including cable means interconnecting said piston with said spool such that the back and forth movement of said piston between said inlet/outlet ports causes said cable means to rotate said spool about its own axis in a corresponding manner, whereby the rotational position of said spool at any given time in the operation of the pump corresponds to the position of said piston within said cylinder housing at that time; and (h) said drive means including an overall hydraulic circuit interconnecting said cylinder housing with said supply of pressurized fluid and said low pressure environment and wherein said cable means including at least one cable disposed entirely within said hydraulic circuit.

14. A fluid actuated pump, comprising (a) means defining a cylinder housing and first and second spaced-apart inlet/outlet drive ports in fluid communication with said housing;

(b) a piston mounted within said cylinder housing for reciprocating movement between said inlet/outlet ports;

(c) drive means including a supply of fluid under pressure and control means for directing pressurized fluid from said supply into said cylinder housing alternatively through each of said first and second inlet/outlet ports while maintaining the other of said ports in fluid communication with a sufficiently low pressure environment to cause said piston to move away from the port receiving said the pressurized fluid and towards the other port;

(d) a control valve forming part of said control means and including (i) means defining a valve housing in fluid communication with said first and second inlet/outlet ports, said supply of pressurized fluid, and said low pressure environment, and (ii) a valve spool mounted within said valve housing for reciprocating movement between a first extreme position for opening said first and second inlet/outlet ports to said supply of pressurized fluid and said low pressure environment, respectively, a second extreme position for opening said second and first inlet/outlet ports to said supply of pressurized fluid and said low pressure environment, respectively, and a third intermediate position for closing both of said inlet/outlet ports to said supply and low pressure environment;

(e) means forming part of said control means for monitoring the position of said piston as it moves back and forth between said first and second inlet/-outlet ports; and (f) valve actuating means forming part of said control means and responsive to the position of said piston within said cylinder housing for (i) maintaining said spool fixed in its first position for at least a part of the time it takes for said piston to move from said first inlet/outlet port to said second inlet/outlet port, (ii) moving said spool from its first position across said third position and to said second position when said piston reaches said second port from said first port, (iii) maintaining said spool fixed in its second position for at least a part of the time it takes for said piston to move from said second port to said first port, and (iv) moving said spool from its second position across said third position and back to said first position when said piston reaches said first port from said second port;

(g) said valve spool being mounted within said valve housing for rotation about its own axis and said position monitoring means including cable means interconnecting said piston with said spool such that the back and forth movement of said piston between said inlet/outlet ports causes said cable means to rotate said spool about its own axis in a corresponding manner, whereby the rotational position of said spool at any given time in the operation of the pump corresponds to the position of said piston within said cylinder housing at that time; and (h) said cable means disposed entirely with the hydraulic circuit which interconnects said cylinder housing with said supply of pressurized fluid and said low pressure environment.

* * * * *